United States Patent [19]

di Donato

[11] 4,200,288

[45] Apr. 29, 1980

[54] TOSS AND TUMBLE TOY

[76] Inventor: Jose J. di Donato, 3545 Island Park, Wantagh, N.Y. 11793

[21] Appl. No.: 829,788

[22] Filed: Sep. 1, 1977

[51] Int. Cl.[2] ..... A63B 65/00

[52] U.S. Cl. ..... 273/428; 273/58 K

[58] Field of Search ..... 273/106 R, 106 A, 106 F, 273/58 R, 58 K, 199 A; 46/74 R

[56] References Cited

U.S. PATENT DOCUMENTS

| | | | |
|---|---|---|---|
| 185,934 | 1/1877 | Kearney | 273/58 R |
| 2,009,759 | 7/1935 | Brown | 273/106 A UX |
| 2,040,522 | 5/1936 | Mark | 273/199 A UX |
| 2,509,087 | 5/1950 | Edmund | 273/58 R |
| 3,118,675 | 1/1964 | Lyle | 273/58 K X |
| 3,393,911 | 7/1968 | Lawson | 273/106 R |
| 3,437,147 | 4/1969 | Davies | 273/58 K X |
| 3,759,518 | 9/1973 | Mroz | 273/58 K X |
| 4,088,319 | 5/1978 | Clark | 273/58 R |

FOREIGN PATENT DOCUMENTS

| | | | |
|---|---|---|---|
| 14452 | of 1905 | United Kingdom | 273/199 A |

OTHER PUBLICATIONS

Spencer Gifts Catalog, p. 37, "Crazy Ball", 12–1966.

*Primary Examiner*—Paul E. Shapiro

[57] ABSTRACT

A toss and tumble toy comprised of a lightweight pliable body member having a pre-disposed geometric configuration such as a cube or cylinder with a plurality of tail like members attached to the body surfaces at discrete locations with fluted pliable flaps at the extremities of the tails so that tails and flaps may provide aerodynamic stability and control of the toy when functioning during the toss and tumble process.

6 Claims, 2 Drawing Figures

TOSS AND TUMBLE TOY

This invention relates to tossable toys and in particular to toss and tumble toys that are spinable and rotatable, and having stability aerodynamically and gravitationally.

Tossing toys generally such as balls, flat discs, hoops and the like do not have stability in the toss or when they impact the ground, rather they fly in a haphazard manner and upon ground impact goes in all directions and without any possible bearing.

It is an object of the invention as contemplated herein to develop toss and tumble toys which rotate, spin and behave with stability, both in flight and when impacting the ground.

Another object of the invention is to provide a toss and tumble toy that can be easily tossed, caught in mid-air and easily retreaved when the toy impacts the ground.

A still further object of the invention is to provide a toss and tumble toy having a variety of configurations and artistic designs for creating and giving estetic effects.

And still a further object of the invention is to create a toss and tumble toy that can be used as a game toy with various participants taking part in the game and various type games being made possible.

A further object of the invention is to provide a toy made of a variety of materials and colors for creating various cosmetic effects and permitted to carry various types of information concealable or otherwise with the receiver of the toy receiving the communication held by the toy.

Further objects and advantages will become apparent from a reading of the specifications and a study of the accompanying drawings.

Figure 1:
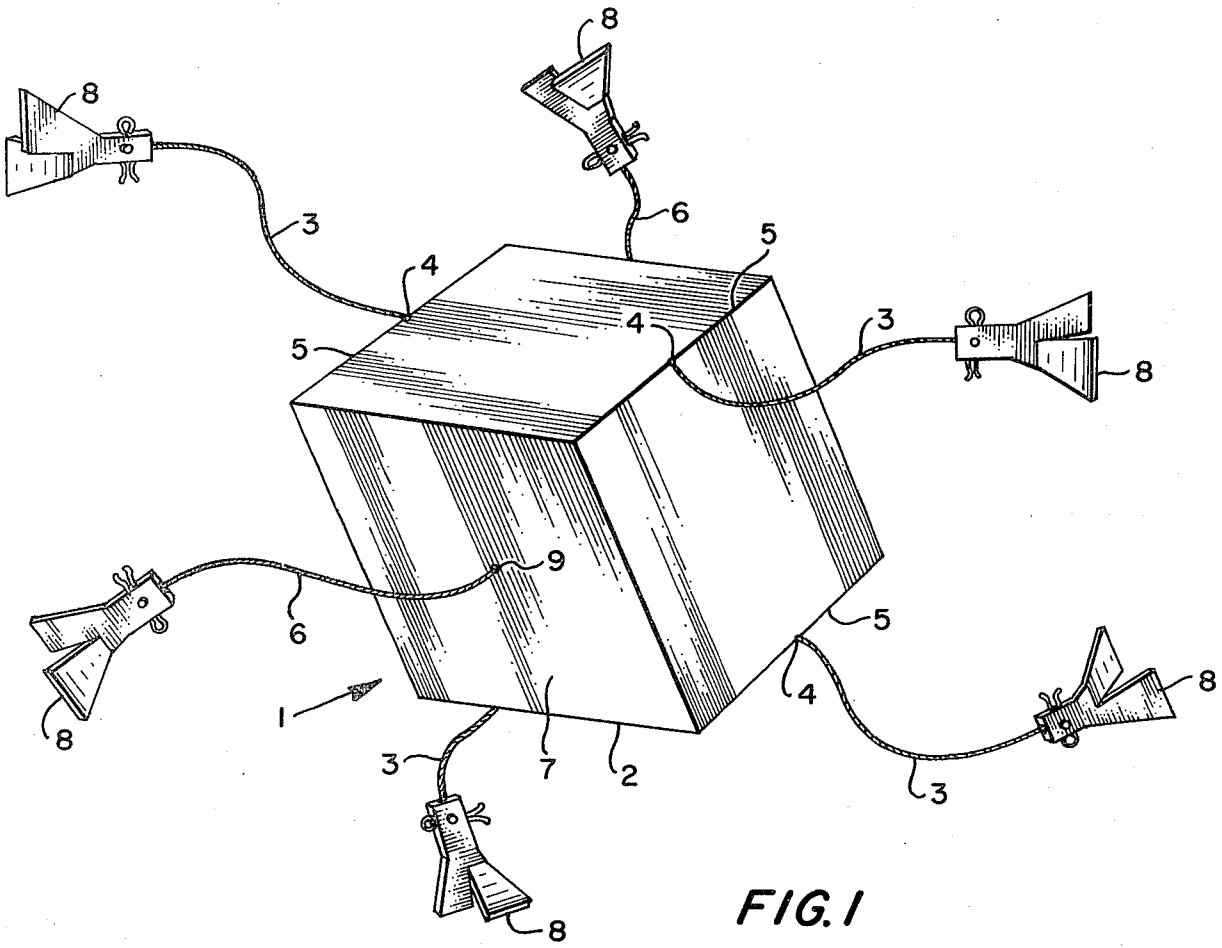
FIG. 1 shows the toss and tumble toy in cubic form according to one embodiment of the invention.

Now describing the invention with particularity there is shown in FIG. 1 a perspective view of the toss and tumble toy 1 shaped in the form of a cube 2 having a plurality of tail pieces 3 attached to mid-point 4 of the cube edges 5 and a plurality of tail pieces 6 attached to the cube faces 7,8 about the central part 9 thereof. Each of the respective tail pieces as shown in the FIG. has connected thereto at the extremities thereof a set of flutter flaps 8 for the purpose of stabilizing the tail pieces and also for each grasp when the toy is tossed or caught.

In tossing the toy generally done in an under-handed manner the toy is made to spin by virtue of the manner in which the toss is made and made by the grabbing of one of the tails. The tossing by the tail gives the toy an initial spin, and the toy in the spinning is kept spinning by the aerodynamics effects of all the other tails spinning with the toy. Its as if a series of propellars were in action giving the toy not only the effective spinning action, but also stabilizing the toy so that the toy goes to its intended destination. Further the tails by their initial effect keeps the toy spinning in a stable manner giving better direction.

The toy upon impact with the ground, if not caught by the intended receiver, will come to a halt and stand still because of the resistive created by the tails. This rapid halt is very advantagous because there is no need to retrieve at a great distance from the intended receiver such as a ball and the like, and is of particular importance where children are concerned because of the safety factor involved.

Figure 2:
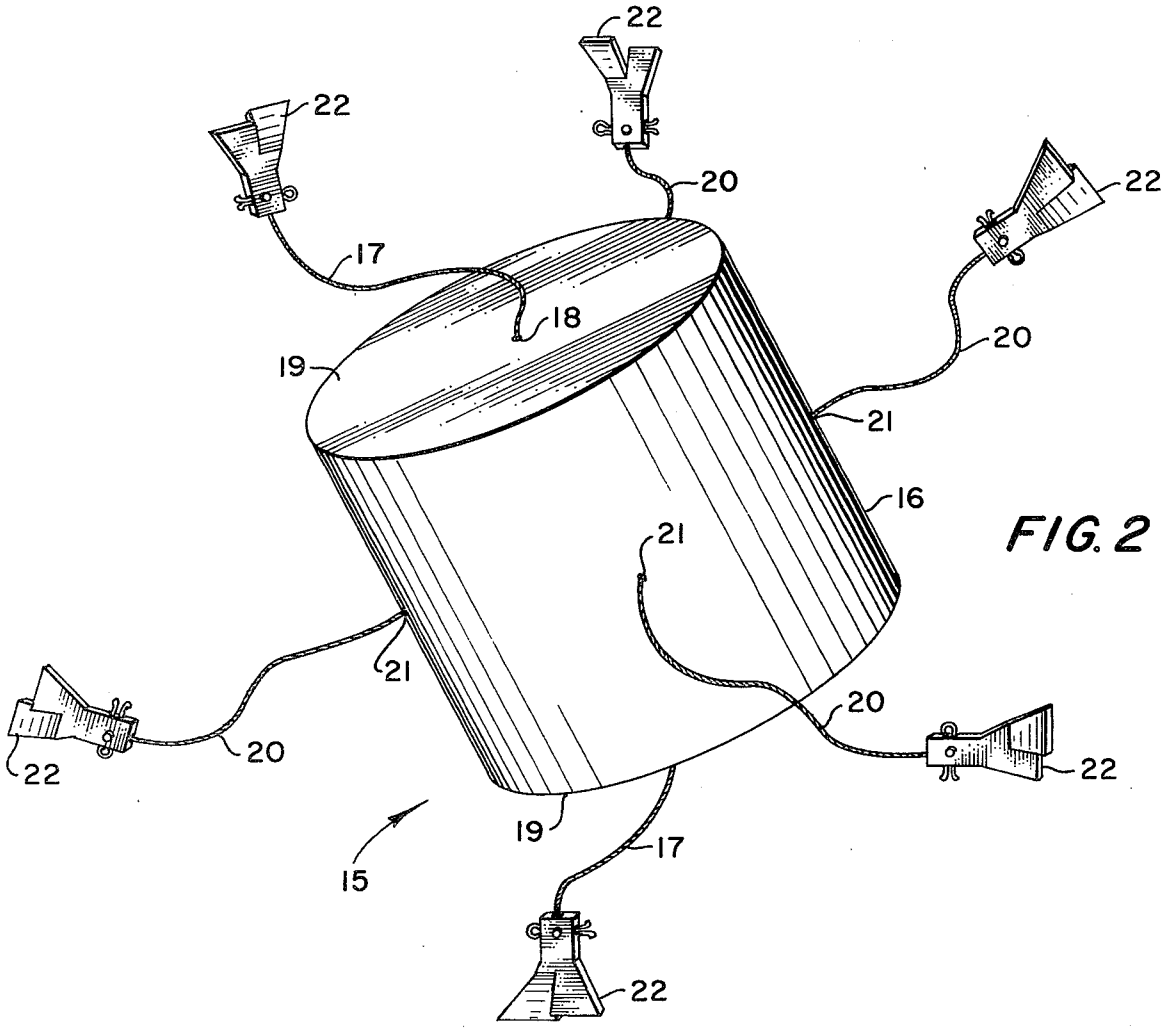
FIG. 2 shows the toss and tumble toy in cylindrical form according to another embodiment of the invention.

FIG. 2 represents another embodiment of the invention in that the toss and tumble toy 15 is configured in cylindrical form 16 and having tail like members 17 extending from the axial centers 18 of the cylindrical faces 19. Another series of tail like members 20 extend outward from the periphery of the cylinder about the midpoint 21 thereof. Here again the extremities of the tail members have attached thereto flutter-flaps 22 fluted in a manner to provide stability to the tail members and also for making it easy to grab the toy and project same or to catch same.

The toss and tumble toy can be made of a variety of pliable materials such as porous sponge, corrugated card board, styro foam, rubber and the like, and that the tail like members also can be made of nylon or plastic materials, and considerably flexible and pliable for the use intended. The flaps at the tail extremities can be made of plastic or nylon however with a more structurally rigid composure.

The toss and tumble toy as shown and described above may have other geometric configurations, and the number and location of the tail members may be altered depending upon the type of game contemplated and the human element involved. Further the toy made have a variety of colors, decals, drawings and sketches about the toy for game and estetic effects.

There are other embodiments contemplated by the invention herein, but that those illustrated are merely by way of illustration and depicting a representative embodiment, and it is understood various changes and arrangements can be made without detracting from the true purpose and intent of the invention disclosed herein.

Having defined the invention what is claimed is:

1. A toss and tumble toy a body member having a pre-disposed geometric and artistic surface configuration, a plurality of tail like members attached to said body along the said surface at discrete locations thereon and flap members attached to the extremities of said tail like members the said tail, and flaps providing aerodynamic stability and control of the toy when functioning during the toss and tumble process.

2. A toss and tumble toy according to claim 1 and wherein said geometric configuration is cubic having the tail members attached to the center of the edges thereof and tail members attached to the mid-point of the surfaces thereof.

3. A toss and tumble toy according to claim 1 and wherein said geometric configuration is cylindrical having tail members attached to the mid-point of the end portion of the cylinder and to the elongated side of said cylinder.

4. A toss and tumble toy according to claim 1 and wherein said body member is pliable and lightweight for easy tossing and tumbling.

5. A toss and tumble toy according to claim 1 and wherein said tail members are of pliable material.

6. A toss and tumble toy according to claim 1 and wherein said flap members are fluted and pliable.

* * * * *